US009686603B2

(12) United States Patent
Zheng et al.

(10) Patent No.: US 9,686,603 B2
(45) Date of Patent: Jun. 20, 2017

(54) FREELY ADJUSTABLE ERGONOMIC BONE CONDUCTION EARPHONE RACK

(71) Applicant: Transound Electronics Co., Ltd., Dongguan (CN)

(72) Inventors: Huming Zheng, Dongguan (CN); Yu Zhang, Dongguan (CN); Tseng-feng Wen, Dongguan (CN)

(73) Assignee: TRANSOUND ELECTRONICS CO., LTD., Dongguan, Guangdong (CN)

( * ) Notice: Subject to any disclaimer, the term of this patent is extended or adjusted under 35 U.S.C. 154(b) by 0 days.

(21) Appl. No.: 15/131,045

(22) Filed: Apr. 18, 2016

(65) Prior Publication Data

US 2017/0127167 A1 May 4, 2017

(30) Foreign Application Priority Data

Nov. 4, 2015 (CN) ..... 2015 2 0870570 U

(51) Int. Cl.
*H04R 25/00* (2006.01)
*H04R 1/10* (2006.01)
*H04R 5/033* (2006.01)

(52) U.S. Cl.
CPC ..... *H04R 1/105* (2013.01); *H04R 1/1008* (2013.01); *H04R 1/1066* (2013.01); *H04R 1/1091* (2013.01); *H04R 5/0335* (2013.01); *H04R 2201/107* (2013.01); *H04R 2420/07* (2013.01); *H04R 2460/13* (2013.01)

(58) Field of Classification Search
CPC .... H04R 1/105; H04R 1/1008; H04R 1/1016; H04R 1/1066; H04R 1/1091; H04R 2201/105; H04R 25/606; H04R 2201/107; H04R 2420/07; H04R 2460/13; H04M 1/05
USPC ..... 381/309, 326, 151, 370, 374, 376, 377, 381/378, 379, 380, 381, 383; 181/128, 181/129, 130, 135; 379/430
See application file for complete search history.

(56) References Cited

U.S. PATENT DOCUMENTS 6,104,824 A * 8/2000 Ito ..... H04R 5/0335 379/430
6,456,721 B1 * 9/2002 Fukuda ..... H04R 1/1066 381/151
8,170,261 B2 * 5/2012 Danielson ..... H04R 1/1008 381/374

* cited by examiner

*Primary Examiner* — Huyen D Le
(74) *Attorney, Agent, or Firm* — Leong C. Lei

(57) ABSTRACT

A freely adjustable ergonomic bone conduction earphone rack and bone conduction earphone using the same are disclosed. The rack includes a head-mounted unit, ear-hung units and mounting units, where the ear-hung unit is respectively configured on the two ends of the head-mounted unit, and the mounting unit is coupled to the ear-hung unit; the mounting unit has a connection section in connection with the ear-hung unit and mounting section for the mounting of a bone conduction vibrator, where at least the connection section is a soft plastic body, and the mounting unit is configured to be adjustable freely multi-directional relatively to the ear-hung unit with the deformation of the connection section.

9 Claims, 4 Drawing Sheets

FREELY ADJUSTABLE ERGONOMIC BONE CONDUCTION EARPHONE RACK

TECHNICAL FIELD OF THE INVENTION

The present invention relates to a bone connection earphone, and more particularly to a freely adjustable ergonomic bone conduction earphone rack and bone conduction earphone using the seam.

DESCRIPTION OF THE PRIOR ART

A bone conduction earphone is placed on the check bones in front of ears when in use compared to a general earphone, and sound is conducted directly to inner ears through cranial bones such that a user's ears are in an open state; the external environmental sounds are not blocked from entering the ears, and the user can even listen to music while chatting with other persons.

Head mounted bone conduction earphones are more popular among bone conduction earphones, mainly including an earphone rack and bone conduction vibrator respectively mounted on the two ends of the earphone rack, where the earphone rack generally includes a head-mounted unit, ear-hung units and mounting units, and the bone conduction vibrator is mounted on the mounting unit. The distance between the two mounting units decides roughly adaptive human face width, and manufacturers might design children's product or adult product, or large, medium and small size products. However, because users have different face widths, head mounted bone conduction earphones are difficult to be adapted with different uses; some of them will feel uncomfortable because their faces are clamped too tight upon wearing them.

SUMMARY OF THE INVENTION

The main object of the present invention is to provide a freely adjustable ergonomic bone conduction earphone rack and bone conduction earphone using the same, realizing skillfully the free adjustment of a mounting unit according to a user's face width and shape, and increasing a user's wearing comfort effectively such that the design of the present invention is more nimble and humanized.

To achieve the object mentioned above, the present invention proposes a freely adjustable ergonomic bone conduction earphone rack, including a head-mounted unit, ear-mounted units and mounting units for the mounting of a bone conduction vibrator, where the ear-hung unit is respectively configured on the two ends of the head-hung unit, and the mounting unit is in connection with the ear-hung unit, where the mounting unit has a connection section in connection with the ear-hung unit and a mounting section for the mounting of the bone conduction vibrator. Furthermore, at least the connection section is a soft plastic body, and the mounting unit is configured to be adjustable freely multi-directionally relatively to the ear-hung unit with the deformation of the connection section.

Preferably, the ear-hung unit is a hard plastic body, the whole mounting unit is a hard plastic body, and the connection between the mounting unit and ear-hung unit is formed by covering hard plastics with soft plastics.

Preferably, a few grooves extended transversely are indented on the outer surface of the connection section.

Preferably, the mounting unit is configured to be inclined inward relatively to the ear-hung unit.

Preferably, the ear-hung unit is a hollow cavity structure, and the inside thereof is configured with a Bluetooth module.

Preferably, the ear-hung unit includes an outer shell formed by means of piecing-together from a left and right split state and an inner side shell, where the outer shell has an outer wall, top wall and bottom wall, and the outer shell also has an inner opening, on which the inner shell is covered.

Preferably, the ear-hung unit includes a rear positioning arm, top positioning arm and front positioning arm, where the rear positioning arm is extended rearward obliquely to be in connection with the end of the head-mounted unit, the top positioning arm is connected between the rear positioning arm and front positioning arm, the front positioning arm is configured to extend downward, and the Bluetooth module is mounted inside the rear positioning arm.

The present invention also proposes a bone conduction earphone using the freely adjustable ergonomic bone conduction earphone rack mentioned above, including the bone conduction earphone rack mentioned above and the bone conduction vibrator respectively mounted on the two ends of the bone conduction earphone rack.

Preferably, the inner face of the mounting unit is indented with a mounting cavity, inside which the bone conduction vibrator is positioned, the opening of the mounting cavity is configured with a plastic cover having a peripheral wall and bottom wall, where the outer surface of the peripheral wall is projected with a few positioning raised portions; the positioning raised portions are got stuck and limited inside the mounting cavity, and the bottom wall is exposed out of the opening of the mounting cavity when the peripheral wall is inserted inside the mounting cavity.

The present invention has obvious advantages and beneficial effects compared to the prior arts. Specifically from the technical solutions mentioned above, the present invention mainly at least designs the connection section as a soft plastic body and allows the mounting unit to be adjustable freely multi-directionally relatively to the ear-hung unit with the deformation of the connection section, thereby achieving skillfully the object of adjusting the mounting unit freely according to users' face widths and shapes, and improving user's wearing comfort effectively. Therefore, the present invention is much more nimble, humanized in design compared to the prior arts.

DETAILED DESCRIPTION OF THE PREFERRED EMBODIMENTS

Figure 1:
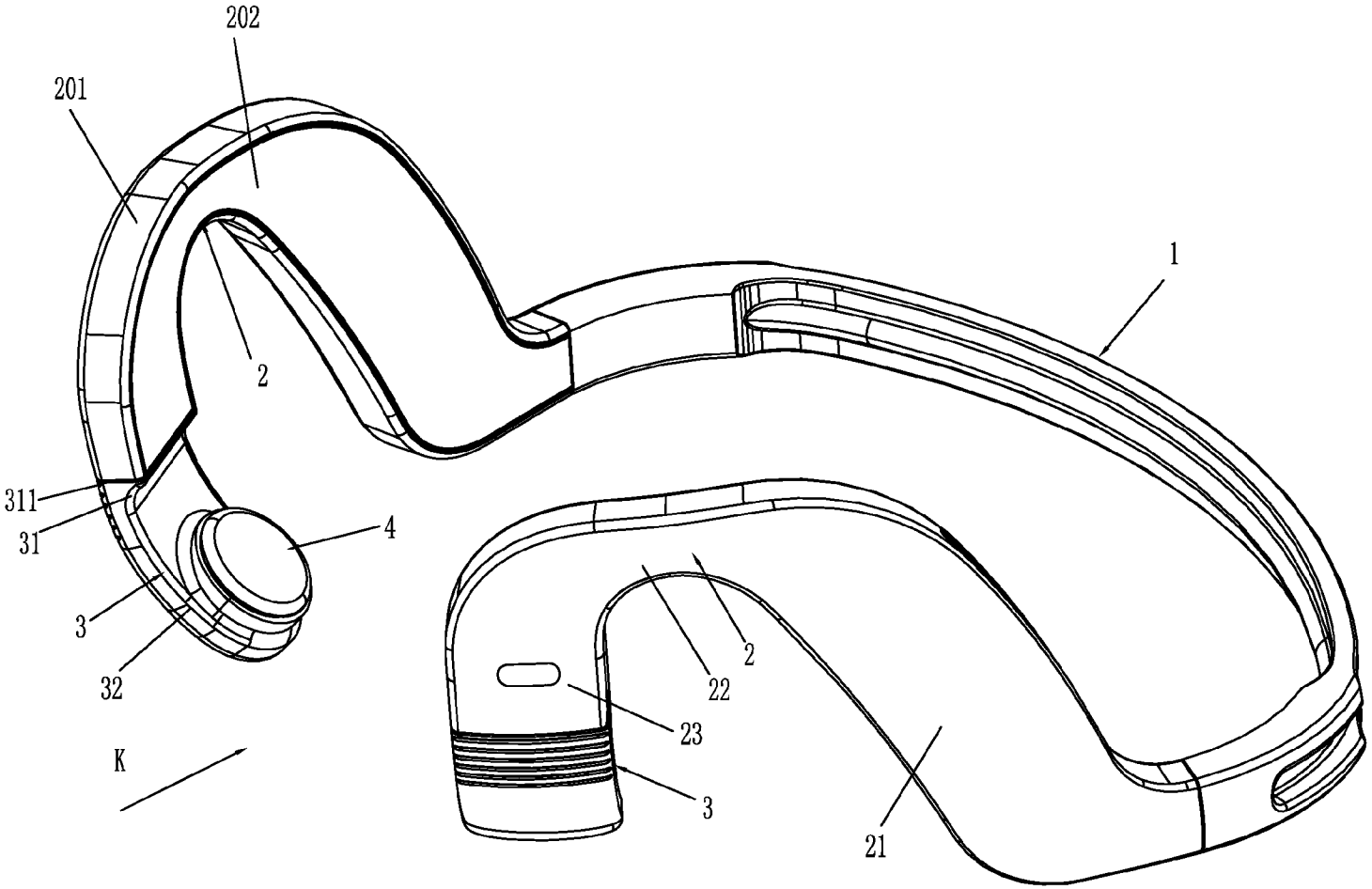
FIG. 1 is a perspective view of a preferred embodiment according to the present invention.
Figure 2:
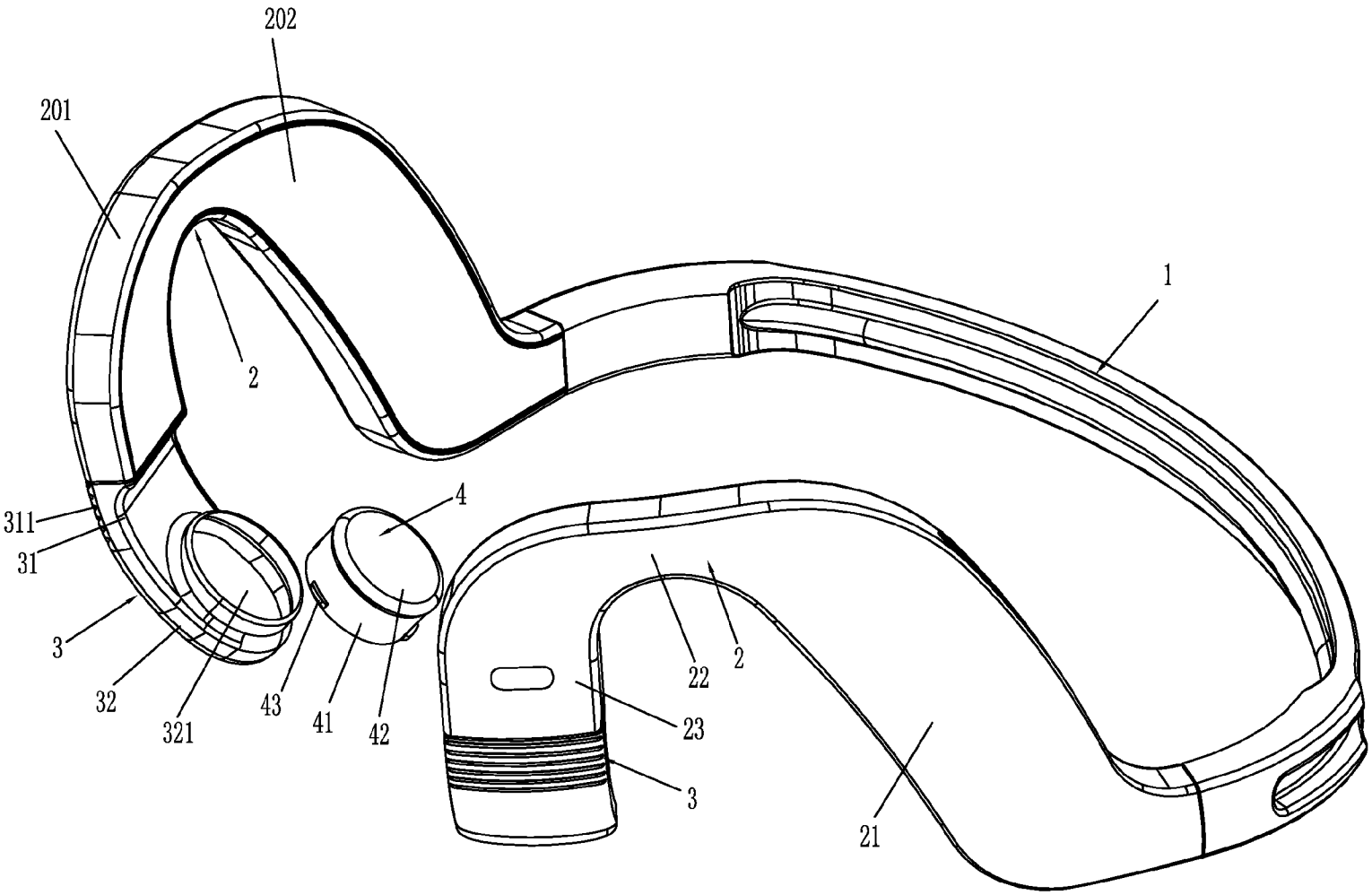
FIG. 2 is an exploded view of the embodiment according to the present invention.
Figure 3:
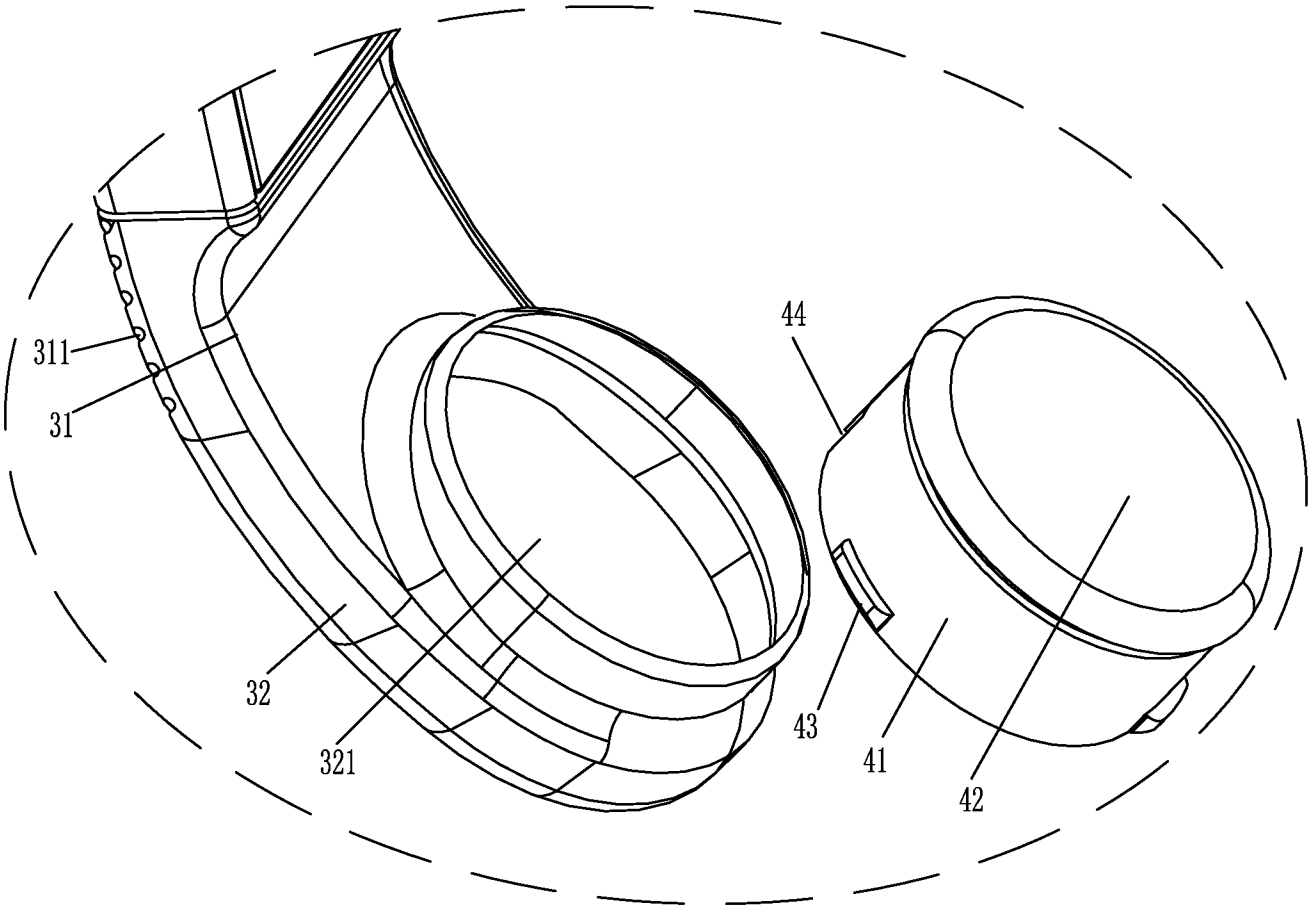
FIG. 3 is a partly enlarged view of FIG. 2.
Figure 4:
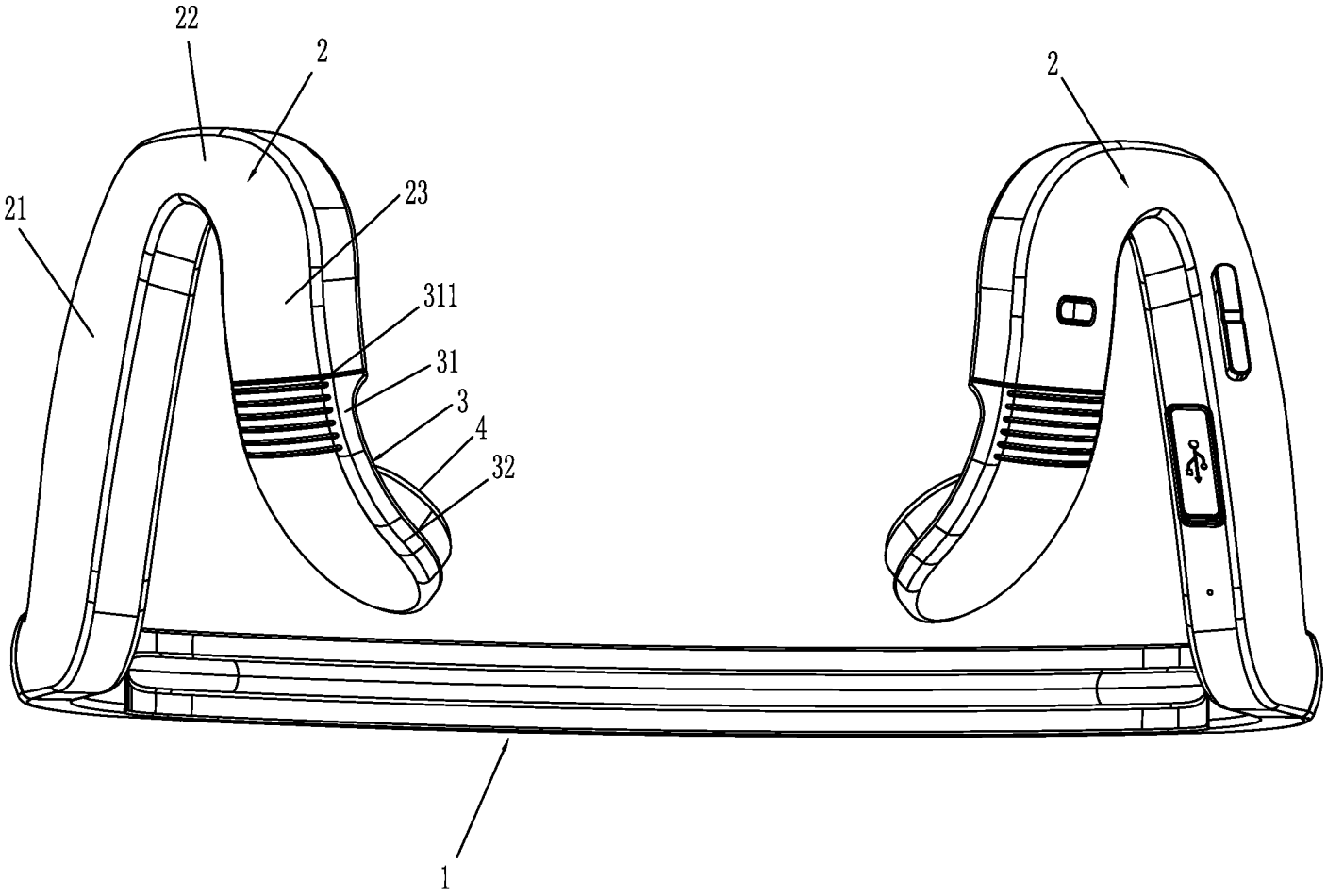
FIG. 4 is a perspective view of the embodiment viewing in the K direction shown in FIG. 1.

Referring to FIGS. 1 to 4, which show a specific structure of a preferred embodiment according to the present invention, here, a head mounted Bluetooth bone conduction earphone is taken as an example to explain. The bone conduction earphone includes a bone conduction earphone rack and a bone conduction vibrator respectively mounted on the two ends of the bone conduction earphone rack. The main innovative design point of the present invention is in that the bone conduction earphone rack is conform to ergonomics and can be adjusted to a corresponding angle according to a user's face width.

The bone conduction rack includes a head-mounted unit 1, ear-hung units 2 and mounting units 3 for the mounting of a bone conduction vibrator, where the ear-hung unit 2 is respectively configured on the two ends of the head-mounted unit 1, and the head-mounted unit 1 may be designed to be an extensible structure generally using metal wires to be connected between the head-mounted unit 1 and ear-hung unit 2; the metal wires are hidden or exposed to change the distances between the two ends of the head-mounted unit 1 and the respective ear-hung unit 2, thereby adjusting the bone conduction earphone rack to adapt it to a head size.

The mounting 3 is in connection with the ear-hung unit 2 and has a connection section 31 in connection with the ear-hung unit 2 and a mounting section 32 for the mounting of a bone conduction vibrator, where at least the connection section 31 is a soft plastic body, and the mounting unit 3 is configured to be adjustable freely multi-directionally relatively to the ear-hung unit 2 with the deformation of the connection section 31. Furthermore, a few grooves 311 extended transversely are indented on the outer surface of the connection section 31, the design of the grooves facilitating the deformation and displacement of the connection section 31 when the mounting unit 3 is rotated outward. In the embodiment, the ear-hung unit 2 preferably is a hard plastic body, and the whole mounting unit 3 soft plastic body, with the connection between the mounting unit 3 and ear-hug unit 2 is formed by covering hard plastics with soft plastics so that the structure is simple and the forming operation is simple. When in use, the mounting unit 3 can be deformed correspondingly and inclined freely relatively to the ear-hung unit 2 to match a user's face width and shape, having a strong adaption and stable use.

Furthermore, in the embodiment, the ear-hung unit 2 is a hollow cavity structure, the inside of which is mounted with a Bluetooth module. In term of assembly structure, the ear-hung unit 2 includes an outer shell 201 formed by means of piecing-together from a left and right split state and an inner shell 202, where the outer shell 201 has an outer wall, top wall and bottom wall. The outer shell 201 also has an inner opening, on which the inner shell 202 is covered. in term of functional structure, the ear-hung unit 2 includes a rear positioning arm 21, top positioning arm 22 and front positioning arm 23, where the rear positioning arm 21 is extended rearward obliquely to be in connection with the end of the head-mounted unit 1, the top positioning arm 22 is connected between the rear positioning arm 21 and front positioning arm 23, and the front positioning arm 23 is configured to extend downward. Furthermore, the Bluetooth module is mounted inside the rear positioning arm 21.

The mounting portion 3 is configured to incline inward relatively to the ear-hung unit 2. The inner face of the mounting unit 3 is indented with a mounting cavity 321, inside which the bone conduction vibrator is positioned, and the opening of the mounting cavity 321 is configured with a plastic cover 4, which has a peripheral wall 41 and bottom wall 42, where the outer surface of the peripheral wall 4 is projected with a few positioning raised portions 43, which are got stuck and limited inside the mounting cavity 321 after the peripheral wall 41 is extended inside the mounting cavity 321, while the bottom wall 42 is exposed out of the opening of the mounting cavity 321. Furthermore, a wire-passing hole is opened on the peripheral wall 41.

The present invention mainly at least designs the connection section as a soft plastic body and allows the mounting unit to be adjustable freely multi-directionally relatively to the ear-hung unit with the deformation of the connection section, thereby achieving skillfully the object of adjusting the mounting unit freely according to users' face widths and shapes, and improving user's wearing comfort effectively. Therefore, the present invention is much more nimble, humanized in design compared to the prior arts.

We claim:

1. A freely adjustable ergonomic bone conduction earphone rack, comprising a head-mounted unit, ear-hung units and mounting units for mounting of a bone conduction vibrator, said ear-hung unit being respectively configured on two ends of said head-mounted unit, and said mounting unit being in connection with said ear-hung unit, wherein said mounting unit has a connection section adapted to be in connection with said ear-hung unit and a mounting section adapted to mount said bone conduction vibrator, wherein at least said connection section is a soft plastic body, and said mounting unit is configured to be adjustable freely multi-directionally relatively to said ear-hung unit with deformation of said connection section.

2. The rack according to claim 1, wherein said ear-hung unit is a hard plastic body, and whole said mounting unit is a soft plastic body, with a connection between said mounting section and ear-hung unit being formed by covering hard plastics with soft plastics.

3. The rack according to claim 1, wherein an outer surface of said connection section is indented with a few transversely extended grooves.

4. The rack according to claim 1, wherein said mounting unit is inclined inward relatively to said ear-hung unit.

5. The rack according to claim 1, wherein said ear-hung unit is a hollow cavity structure, the inside thereof is configured with a Bluetooth module.

6. The rack according to claim 5, wherein said ear-hung unit comprises an outer shell formed by means of piecing-together from a left and right split state and an inner shell, wherein said outer shell has an outer wall, top wall and bottom wall, and also an inner opening on which said inner shell is covered.

7. The rack according to claim 5, wherein said ear-hung unit comprises a rear position arm, top positioning arm and front positioning arm, wherein said rear positioning arm is extended rearward obliquely to be in connection an end of said head-mounted unit, said top positioning arm is connected between said rear positioning arm and front positioning arm, and said front positioning arm is configured to extend downward; said Bluetooth module is configured inside said rear positioning arm.

8. A bone conduction earphone to which the rack according to claim 1 is applied, comprising said bone conduction earphone rack and said bone conduction vibrator respectively mounted on two ends of said bone conduction earphone rack.

9. The earphone according to claim 8, wherein a mounting cavity is indented inside said mounting unit, said bone conduction vibrator is mounted in said mounting cavity, a plastic cover is configured on an opening of said mounting cavity, said plastic cover has a peripheral wall and bottom wall, a few positioning raised portions are configured on an outer surface of said peripheral wall, and said positioning raised portions are got stuck and limited in said mounting cavity after said peripheral wall is inserted in said mounting cavity, while said bottom wall is exposed out of said opening of said mounting cavity.

* * * * *